US011006200B2

(12) United States Patent
El Guindi et al.

(10) Patent No.: US 11,006,200 B2
(45) Date of Patent: May 11, 2021

(54) CONTEXT DEPENDENT TAPPING FOR HEARING DEVICES

(71) Applicant: Sonova AG, Staefa (CH)

(72) Inventors: Nadim El Guindi, Zurich (CH); Nina Stumpf, Männedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/367,328

(22) Filed: Mar. 28, 2019

(65) Prior Publication Data

US 2020/0314521 A1 Oct. 1, 2020

(51) Int. Cl.
*H04R 1/10* (2006.01)

(52) U.S. Cl.
CPC ..... *H04R 1/1041* (2013.01); *H04R 2420/07* (2013.01)

(58) Field of Classification Search
CPC ..... H04L 63/0861; H04L 63/102; H04L 65/4084; H04L 67/04; H04L 67/141; H04L 67/18; H04L 67/34; H04R 1/1041; H04R 1/1016; H04R 2420/07; H04R 2430/01; H04R 1/1058; H04R 1/1091; H04R 2201/029; H04R 2201/107; H04R 2225/31; H04R 2460/13; H04R 2499/11; H04R 25/305; H04R 25/405; H04R 25/505; H04R 25/65; H04R 3/005; H04R 5/033; H04R 5/0335; H04S 7/301; H04S 7/302; H04S 7/305
USPC ..... 381/74, 312, 56–58; 700/94
See application file for complete search history.

(56) References Cited

U.S. PATENT DOCUMENTS

| | | | | |
|---|---|---|---|---|
| 9,078,070 | B2 | 7/2015 | Samuels | |
| 10,291,975 | B2 * | 5/2019 | Howell | H04R 29/001 |
| 2010/0054518 | A1 | 3/2010 | Goldin | |
| 2010/0246836 | A1 * | 9/2010 | Johnson, Jr. | H04R 5/04 381/58 |
| 2011/0206215 | A1 | 8/2011 | Bunk | |
| 2011/0210926 | A1 * | 9/2011 | Pasquero | G06F 3/016 345/173 |
| 2012/0135687 | A1 * | 5/2012 | Thorn | H04M 1/7253 455/41.2 |
| 2014/0111415 | A1 * | 4/2014 | Gargi | G06F 3/017 345/156 |
| 2020/0162825 | A1 * | 5/2020 | El Guindi | H04R 25/505 |
| 2020/0314525 | A1 * | 10/2020 | Thielen | H04R 25/30 |

* cited by examiner

*Primary Examiner* — Lun-See Lao

(57) ABSTRACT

The disclosed technology generally relates to a hearing device configured adjust the tap detection sensitivity on based on context. The disclosed technology can determine a context for a hearing device based on sound received at the hearing device (e.g., determine loud environment) or a wireless communication signal from an external device received at the hearing device (e.g., receive a message that phone call is incoming); adjust a tapping sensitivity threshold of the hearing device based on the context; detect a tap of the hearing device based on the adjusted sensitivity threshold; and modify a setting of the hearing device (e.g., reduce volume based on a tap) or transmitting instructions to the external device based on detecting the tap. The hearing device can be a hearing aid.

13 Claims, 4 Drawing Sheets

CONTEXT DEPENDENT TAPPING FOR HEARING DEVICES

TECHNICAL FIELD

The disclosed technology generally relates to a hearing device configured to adjust tap detection sensitivity based on context.

BACKGROUND

To improve everyday user satisfaction with hearing devices, a hearing device user desires a simple means to adjust hearing device parameters. Currently, users can toggle buttons or turn dials on the hearing device to adjust parameters. For example, a user can toggle a button to increase the volume of a hearing device.

Hearing device users can also use remote controls or control signals from an external wireless device to adjust parameters of hearing devices. For example, a user can have a remote control that has a "+" button for increasing the volume of a hearing device and "−" for decreasing the volume of a hearing device. If the user pushes either button, the remote control transmits a signal to the hearing device and the hearing device is adjusted in accordance with a control signal. Similar to a remote control, a user can use a mobile device to adjust the hearing device parameters. For example, a user can use a mobile application and its graphical user interface to adjust the settings of a hearing device. The mobile device can transmit wireless control signals to the hearing device accordingly.

However, the current technology for adjusting a hearing device has a few drawbacks. To push a button or turn a dial, a user generally needs good dexterity to find and engage the button or dial appropriately. This can be difficult for users with limited dexterity or it can be cumbersome to perform because a user may have difficulty seeing the location of these buttons (especially for elderly individuals). Additionally, a button generally can provide only one or two inputs (push and release), which limits the number of settings a user can adjust. Further, if a user wants to use an external device to adjust the hearing device, the user must have the external device present the external device and it must be functional, which may not always be possible.

Accordingly, there exists a need to provide technology that allows a user to easily adjust hearing device parameters and provide additional benefits.

SUMMARY

This summary is provided to introduce a selection of concepts in a simplified form that are further described below in the Detailed Description. This summary is not intended to identify key features of the claimed subject matter.

The disclosed technology can include a hearing device. The hearing device can comprise: a microphone configured to receive sound and convert the sound into audio signals; an accelerometer configured to detect a change in acceleration of the hearing device; a processor configured to receive the audio signals from the microphone and receive information from the accelerometer; a memory, electronically coupled to the processor, the memory storing instructions that cause the hearing device to perform operations. The operations can comprise: determining a context for the hearing device based on sound received at the hearing device or a wireless communication signal from an external device received at the hearing device; adjusting a tapping sensitivity threshold of the hearing device based on the context; detecting a tap of the hearing device based on the adjusted sensitivity threshold; and modifying a parameter of the hearing device or transmitting instructions to the external device based on detecting the tap.

Optionally, determining the context for the hearing device can be based on sound received at the hearing device and the operations can further comprise: determining a classification for the sound received at the hearing device; and adjusting the tapping sensitivity threshold based on the classification. Alternatively or additionally, the determining the context for the hearing can be based on a wireless communication signal from an external device received at the hearing device, and wherein the wireless communication signal is from a mobile device and the wireless communication signal is related to answering or rejecting a phone call.

The disclosed technology includes a method. The method is a method for a wireless communication device to communicate with a hearing device. The method can comprises determining a context for a hearing device based on sound received at the hearing device or a wireless communication signal from an external device received at the hearing device; adjusting a tapping sensitivity threshold of the hearing device based on the context; detecting a tap of the hearing device based on the adjusted sensitivity threshold; and modifying a parameter of the hearing device or transmitting instructions to the external device based on detecting the tap. The method also be stored on a computer-readable medium as operations, wherein a processor can carry out the operations and cause the hearing device to perform the operations.

Figure 1:
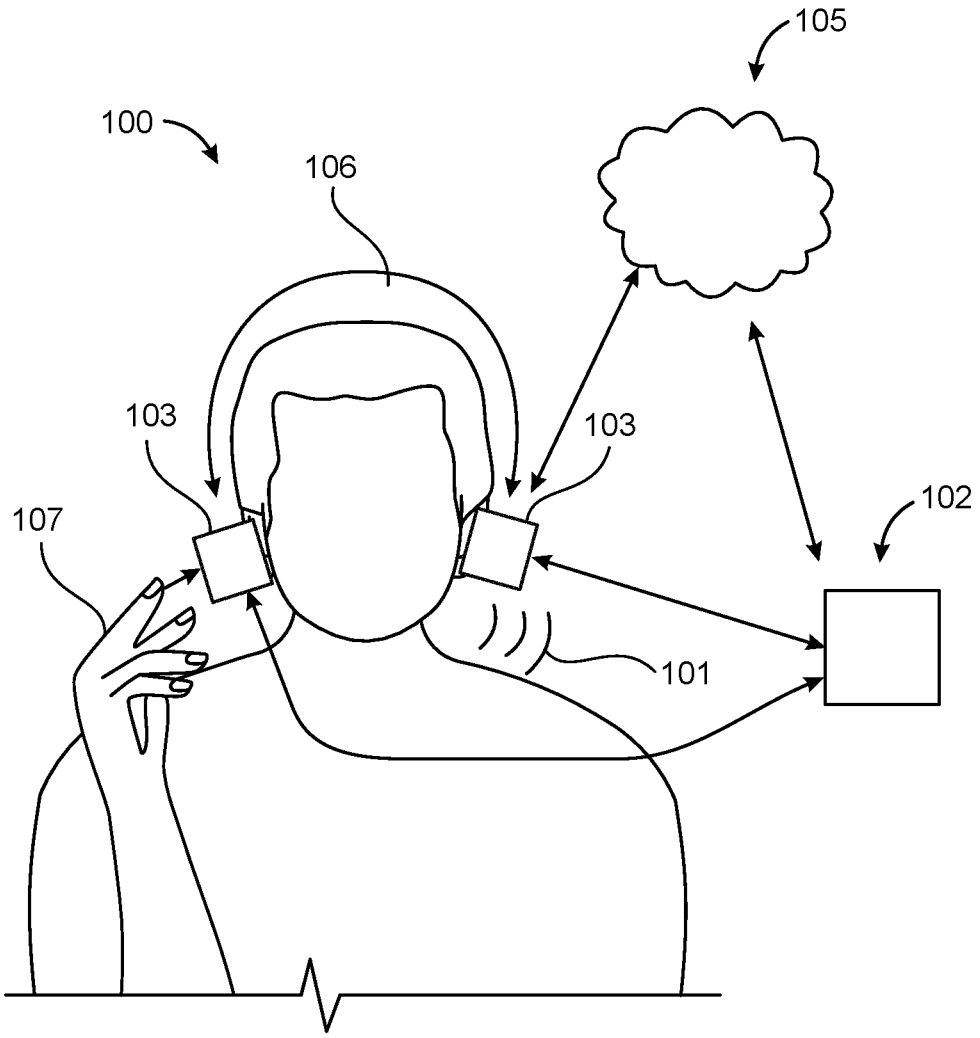
FIG. 1 illustrates a communication environment where a hearing device user can tap a hearing device in accordance with some implementations of the disclosed technology.

The drawings are not to scale. Some components or operations may be separated into different blocks or combined into a single block for the purposes of discussion of some of the disclosed technology. Moreover, while the technology is amenable to various modifications and alternative forms, specific implementations have been shown by way of example in the drawings and are described in detail below. The intention, however, is not to limit the technology to the selected implementations described. On the contrary, the technology is intended to cover all modifications, equivalents, and alternatives falling within the scope of the technology as defined by the appended claims.

DETAILED DESCRIPTION

To enable users to adjust hearing device parameters, hearing devices can have an accelerometer and use it to implement tap control. Tap control generally refers to a hearing device user tapping on the hearing device, tapping on the ear with the hearing device, or tapping on their head a single or multiple times to control the hearing device. Tapping includes touching a hearing device a single or multiple times with a body part or object (e.g., pen).

The accelerometer can sense the tapping based on a change in acceleration and transmit a signal to the processor of the hearing device. In some implementations, a tap detection algorithm is implemented in the accelerometer (e.g., in the accelerometer chip). In other implementations, a processor in the hearing device can receive information from accelerometer, and the processor can implement a tap detection algorithm based on the received information. Also, in some implementations, the accelerometer and the processor can implement different parts of the tap detection algorithm. Based on a detected single tap or double tap, the hearing device can modify a parameter of the hearing device or perform an operation. For example, a single tap or a double tap can cause the hearing device to adjust volume, switch or modify a hearing device program, accept/reject a phone call, or implement active voice control (e.g., voice commands).

However, it is difficult to reliably detect a tap. Reliably detecting a tap means reducing false positives (detected and unwanted taps or vibrations due to handling or movement of the hearing device or other body movements) and false negatives (the user tapped or double tapped but it was not detected) such that a user is satisfied with tap control performance. Further, because hearing devices have different properties that can affect tap or vibration properties the hearing device and users vary in how they tap a hearing device, a "one size fits all" configuration for tap control may be suboptimal for users.

To provide improved tap control, the disclosed technology includes a hearing device that adjusts tap detection parameters based on context. The hearing device can perform operations that determine a context for a hearing device and use the context to adjust tap detection parameters. In some implementations, the operations can comprise: determining a context for the hearing device based on sound received at the hearing device or a wireless communication signal from an external device received at the hearing device; adjusting a tapping sensitivity threshold of the hearing device based on the context; detecting a tap of the hearing device based on the adjusted sensitivity threshold; and modifying a parameter of the hearing device or transmitting instructions to the external device based on detecting the tap.

Here, context generally means the circumstances that form the setting for an event (e.g., before, during, or after a tap). Some examples of contexts are listening to music (e.g., while running or walking), speech, speech in noise, receiving a phone call, or listening to or streaming television. In each of these contexts, a user may tap a device differently. For example, the stop music, the hearing device user may tap a hearing device twice. To respond to a phone call, the user may tap a hearing device twice to answer the call or tap the hearing device once to reject the call. Also, the context can be used to set tap sensitivity. Tap sensitivity refers to a threshold or thresholds for a level necessary for tap detection. If the tap sensitivity is high, this generally means that the threshold for detecting a tap or multiple taps is low because a low threshold is more likely to sense a tap than a high threshold. If the tap sensitivity is low, this generally means that the threshold for detecting a tap or multiple taps is high. Here a threshold can refer to a slope of acceleration or value of acceleration (e.g., absolute magnitude). As an example, if a user is in a noisy environment, the hearing device can increase the tap sensitivity for detecting a tap that relates to reducing the volume output of a hearing device.

The disclosed technology can have a technical benefit or address a technical problem for hearing device tap detection or tap control. For example, the hearing device can use tap detection parameters that are customized for a context so that a tap or double tap are more likely to be accurately detected compared to using a standard tap detection. Additionally, the disclosed technology reduces false detection of taps because it sets the parameters to customized settings that are more likely to detect a tap based on context.

FIG. 1 illustrates a communication environment 100. The communication environment 100 includes wireless communication devices 102 (singular "wireless communication device 102" and multiple "wireless communication devices 102") and hearing devices 103 (singular "hearing device 103" or multiple "hearing devices 103"). A A hearing device user can tap the hearing devices 103 a single or multiple times. A tap can be soft, hard, quick, slow, or repeated. In some implementations, the user can use an object to assist with tapping such as a pen, pencil, or other object configured to be used for tapping the hearing device 103. Although FIG. 1 only shows a user tapping one hearing device 103, a user can tap both hearing devices simultaneously or separately. Also, a hearing device user can speak and generate sound waves 101.

As shown by double-headed bold arrows in FIG. 1, the wireless communication devices 102 and the hearing devices 103 can communicate wirelessly. Wireless communication includes wirelessly transmitting information, wirelessly receiving information, or both. Each wireless communication device 102 can communicate with each hearing device 103 and each hearing device 103 can communicate with the other hearing device. Wireless communication can include using a protocol such as Bluetooth BR/EDR™, Bluetooth Low Energy™, a proprietary protocol communication (e.g., binaural communication protocol between hearing aids based on NFMI or bimodal communication protocol between hearing devices), ZigBee™, Wi-Fi™, or an Industry of Electrical and Electronic Engineers (IEEE) wireless communication standard.

The wireless communication devices 102 shown in FIG. 1 can include mobile computing devices (e.g., mobile phone or tablet), computers (e.g., desktop or laptop), televisions (TVs) or components in communication with television (e.g., TV streamer), a car audio system or circuitry within the car, tablet, remote control, an accessory electronic device, a wireless speaker, or watch.

A hearing device user can wear the hearing devices 103 and the hearing devices 103 provide audio to the hearing device user. A hearing device user can wear single hearing device 103 or two hearing devices, where one hearing device 103 is on each ear. Some example hearing devices include hearing aids, headphones, earphones, assistive listening devices, or any combination thereof; and hearing devices include both prescription devices and non-prescription devices configured to be worn on or near a human head.

As an example of a hearing device, a hearing aid is a device that provides amplification, attenuation, or frequency modification of audio signals to compensate for hearing loss or difficulty; some example hearing aids include a Behind-the-Ear (BTE), Receiver-in-the-Canal (RIC), In-the-Ear (ITE), Completely-in-the-Canal (CIC), Invisible-in-the-Canal (IIC) hearing aids or a cochlear implant (where a cochlear implant includes a device part and an implant part).

The hearing devices 103 are configured to binaurally or bimodally communicate. The binaural communication can include a hearing device 103 transmitting information to or receiving information from another hearing device 103. Information can include volume control, signal processing information (e.g., noise reduction, wind canceling, directionality such as beam forming information), or compression information to modify sound fidelity or resolution. Binaural communication can be bidirectional (e.g., between hearing devices) or unidirectional (e.g., one hearing device receiving or streaming information from another hearing device). Bimodal communication is like binaural communication, but bimodal communication includes two devices of a different type, e.g. a cochlear device communicating with a hearing aid. The hearing device can communicate to exchange information related to utterances or speech recognition.

The network 105 is a communication network. The network 105 enables the hearing devices 103 or the wireless communication devices 102 to communicate with a network or other devices. The network 105 can be a Wi-Fi™ network, a wired network, or e.g. a network implementing any of the Institute of Electrical and Electronic Engineers (IEEE) 802.11 standards. The network 105 can be a single network, multiple networks, or multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. In some implementations, the network 105 can include communication networks such as a Global System for Mobile (GSM) mobile communications network, a code/time division multiple access (CDMA/TDMA) mobile communications network, a 3rd, 4th or 5th generation (3G/4G/5G) mobile communications network (e.g., General Packet Radio Service (GPRS)) or other communications network such as a Wireless Local Area Network (WLAN).

Figure 2:
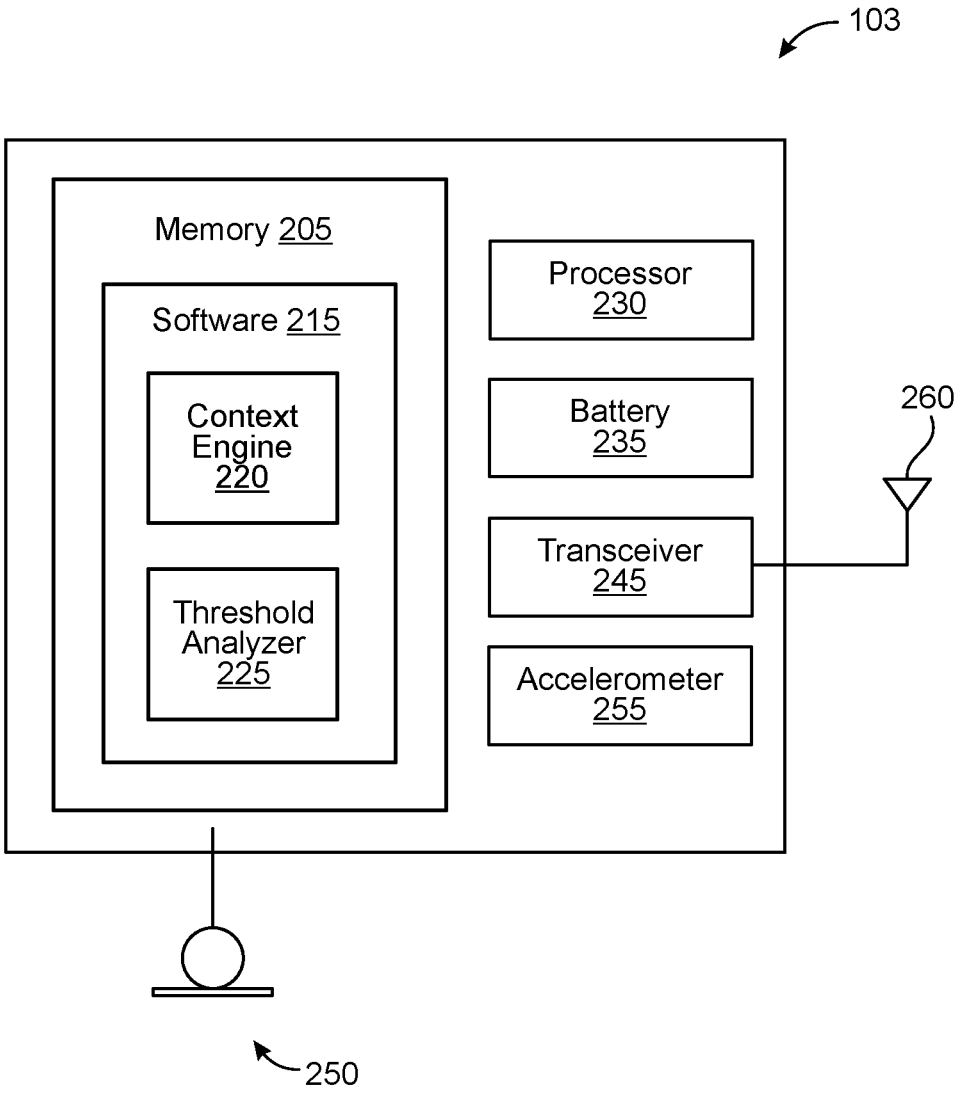
FIG. 2 illustrates a hearing device from FIG. 1 in more detail in accordance with some implementations of the disclosed technology.

FIG. 2 is a block diagram illustrating the hearing device 103 from FIG. 1 in more detail. FIG. 2 illustrates the hearing device 103 with a memory 205, software 215 stored in the memory 205, the software 215 includes a context engine 220 and a threshold analyzer 225. The hearing device 103 in FIG. 2 also has a processor 230, a battery 235, a transceiver 245 coupled to an antenna 260, and a microphone 250. Each of these components is described below in more detail.

The memory 205 stores instructions for executing the software 215 comprised of one or more modules, data utilized by the modules, or algorithms. The modules or algorithms perform certain methods or functions for the hearing device 103 and can include components, subcomponents, or other logical entities that assist with or enable the performance of these methods or functions. Although a single memory 205 is shown in FIG. 2, the hearing device 103 can have multiple memories 205 that are partitioned or separated, where each memory can store different information.

The context engine 220 can determine a context for a single hearing device 103 or both hearing devices 103. A context can be based on the sound received at the hearing device. For example, the context engine 220 can determine that a user is in a quiet environment because there is little sound or soft sound received at the hearing device 103. Alternatively, the context engine 220 can determine the context of a hearing device is in a loud environment such as at a restaurant with music and many people carrying on conversations.

The context engine 220 can also determine context based on sound classification (e.g., performed in a DSP). Sound classification is the automatic recognition of an acoustic environment for the hearing device. The classification can be speech, speech in noise, noise, or music. Sound classification can be based on amplitude modulations, spectral profile, harmonicity, amplitude onsets, and rhythm. The context engine 220 can perform classification algorithms based on rule-based and minimum-distance classifiers, Bayes classifier, neural network, and hidden Markov model.

In some implementations, the classification may result in two or more recommended setting for the hearing device (e.g., speech-in-noise setting versus comfort). And the classifier may determine that the two recommended settings have nearly equal recommendation probability (e.g., 50/50 or 60/40). If the classifier for the hearing device selects one setting and the hearing device user does not like it, he or she may tap once or twice to change the setting to the secondary recommendation setting. In these implementations, the tap sensitivity may be increased (e.g., threshold decreased) because it is more likely a user will tap to adjust the hearing device settings as compared to another setting (e.g., when the hearing device determines that there is a 90% probability the user is happy with a setting).

The context engine 220 can also determine context based on communication with an external device. For example, the context engine 220 can determine that the hearing device 103 received a request from a mobile phone, and the mobile phone is asking the user if he or she wants to answer or reject the phone call. The context engine 220 can thus determine that the context is answering a phone call. More generally, if a wireless communication device 102 sends a request to the hearing device, the hearing device can use this request to determine the context. Some examples of requests include a request to use a wireless microphone, a request to provide audio or information to the hearing device (based on the user's permission), or a request to connect to the wireless device 102 (e.g., TV controller). In response to the his request and the context, the hearing device 103 can anticipate a tap or multiple taps from the user. The hearing device can also adjust the tap sensitivity necessary for detecting a tap based on the context as described with the threshold analyzer 225.

The threshold analyzer 225 can adjust a tapping sensitivity based on a context for the hearing device 103. Tapping sensitivity generally refers to the parameters associated with detecting a tap at or near the hearing device (more generally "tap detection parameters" and when adjusted "adjusted tap parameters"). Generally, a tap is detected if a certain acceleration value or slope of acceleration in a single or multi dimensions is measured. If the threshold is too low, then chances of false positives are high. If the threshold is too high, then the probability of not detecting a tap is high. Also, a tap is not just detected by magnitude, but also by the slope of acceleration (e.g., change in acceleration) or the duration of acceleration. Additionally, if a hearing device uses double or multiple tapping control, the threshold analyzer 225 can adjust the time period expected between taps. The table below includes some examples of context and adjusted tap control.

TABLE 1

| Context | Desired Tap Sensitivity | Adjustment to Tap Sensitivity |
|---|---|---|
| Quiet environment and user sitting | high | Reduced tap sensitivity threshold and/or reduce slope threshold |
| Loud Environment (e.g., classification speech in noise) or listening to music while user is running | high sensitivity for volume down | Reduce tap sensitivity threshold and/or reduce slope for single or double tap to indicate volume down |
| Receiving a phone call (scenario one) | High tap sensitivity | The threshold is generally lowered to reduce the chance of not detecting a tap (when a user receives a phone call, there is a high probability that he/she will tap or double tap to answer the call or reject it). The threshold is generally set to reduce false positives and increase probability that a tap or multiple taps is detected for receiving a phone call. Using a single tap or multiple taps to accept/reject a phone call is a setting in the hearing device that can be changed. |
| Receiving a phone call (scenario two) | Expecting a single tap for accepting phone call and a double tap for rejecting phone call | optimize discrimination between a single tap and a double tap (e.g., adjusting expected quiet time between taps) |
| User is walking, running, or moving quickly | Decrease tap sensitivity | Increase tapping sensitivity threshold or increase slope sensitivity threshold (e.g., to reduce false negatives related to movement of person and not tapping). More generally, increase tap sensitivity threshold to detect a tap because the running, walking, or moving quickly creates vibrations that could be interpreted as taps if tap sensitivity is too high. |
| Beamforming on | high sensitivity | User may single or double tap to turn off beamforming, accordingly reducing the tap sensitivity threshold when the user is likely to want to turn on or turn off beamforming |
| Start-up or turn on sequence | Off | When the hearing device is not worn or just turned on, the tap control should be turned off (e.g., tap sensitivity set to zero). More generally, when the user is not wearing the device or it is booting up, the tap control does not need to be on. |
| 50/50 or 60/40 scenarios | Increase tap sensitivity | Decrease tap sensitivity threshold. 50/50 or 60/40 scenarios generally include a classifier identifying a hearing device setting that is preferred for a particular listening scenario, but the preferred setting is likely preferred 50% or 60% of the time compared to a secondary setting. In such scenarios, the hearing device user can tap the hearing device to switch from the first preferred setting to the second preferred setting (e.g., beamforming is the first setting and comfort listening is the second). Because it is likely that a user could change the setting with a tap, the tap sensitivity is increased (e.g., the threshold is lowered). |

The processor 230 can include special-purpose hardware such as application specific integrated circuits (ASICs), programmable logic devices (PLDs), field-programmable gate arrays (FPGAs), programmable circuitry (e.g., one or more microprocessors microcontrollers), Digital Signal Processor (DSP), Neural network engines, appropriately programmed with software and/or computer code, or a combination of special purpose hardware and programmable circuitry. Especially, neural network engines might be analog or digital in nature and contain single or multiple layers of feedforward or feedback neuron structures with short and long term memory and/or different nonlinear functions.

Also, although the processor 230 is shown as a separate unit in FIG. 2, the processor 230 can be on a single chip with the transceiver 245, and the memory 205. The processor 230 can also include a DSP configured to modify audio signals based on hearing loss or hearing programs stored in the memory 205. In some implementations, the hearing device 103 can have multiple processors, where the multiple processors can be physically coupled to the hearing device 103 and configured to communicate with each other.

The accelerometer 255 can be positioned inside the hearing device and detect acceleration changes of the hearing device. The accelerometer 255 can be a capacitive accelerometer, a piezoelectric accelerometer, or another type of accelerometer. In some implementations, the accelerometer can measures acceleration along only a single axis. In other implementations, the accelerometer can sense acceleration along two axes or three axes. For example, the accelerometer can create a 3D vector of acceleration in the form of orthogonal components. The accelerometer can output a signal that is received by the processor 230. The acceleration can be output in meters/second$^2$ or g's (1 g=9.81 meters/second$^2$). In some implementations, the accelerometer can detect acceleration changes from +2 g's to +16 g's sampled at a frequency of greater than 100 Hz, e.g., 200 Hz.

The accelerometer 255 can also be in a housing of the hearing device, where the housing is located behind a user's ear. Alternatively, the accelerometer 255 can be located in a housing for a hearing device, wherein the housing is inside a user's ear canal or at least partially inside a user's ear. The accelerometer 255 can be an ultra-low power device, wherein the power consumption is within a range or 10 micro Amps (μA). The accelerometer 255 can be a micro-electro-mechanical system (MEMS) or nanoelectromechanical system (NEMS).

The battery 235 can be a rechargeable battery (e.g., lithium ion battery) or a non-rechargeable battery (e.g., Zinc-Air) and the battery 235 can provide electrical power to the hearing device 103 or its components. In general, the battery 235 has significantly less available capacity than a battery in a larger computing device (e.g., a factor 100 less than a mobile phone device and a factor 1000 less than a laptop).

The microphone 250 is configured to capture sound and provide an audio signal of the captured sound to the processor 230. The microphone 250 can also convert sound into audio signals. The processor 230 can modify the sound (e.g., in a DSP) and provide the processed audio derived from the modified sound to a user of the hearing device 103. Although a single microphone 250 is shown in FIG. 2, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphones to perform beam forming operations. In such an example, the processor 230 would include a DSP configured to perform beam forming operations.

The antenna 260 can be configured for operation in unlicensed bands such as Industrial, Scientific, and Medical Band (ISM) using a frequency of 2.4 GHz. The antenna 260 can also be configured to operation in other frequency bands such as 5.8 GHz, 3.8 MHz, 10.6 MHz, or other unlicensed bands.

Although not shown in FIG. 2, the hearing device 103 can include additional components. For example, the hearing device can also include a transducer to output audio signals (e.g., a loudspeaker or a transducer for a cochlear device configured to convert audio signals into nerve stimulation or electrical signals). Further, although not shown in FIG. 2, the hearing device can include sensors such as a photoplethysmogram (PPG) sensor or other sensors configured to detect health conditions regarding the user wearing the hearing device 103.

Also, the hearing device 103 can include an own voice detection unit configured to detect a voice of the hearing device user and separate such voice signals from other audio signals. To implement detecting own voice, the hearing device can include a second microphone configured to convert sound into audio signals, wherein the second microphone is configured to receive sound from an interior of an ear canal and positioned within the ear canal, wherein a first microphone is configured to receive sound from an exterior of the ear canal. The hearing device can also detect own voice of a hearing device user based on other implementations (e.g., a digital signal processing algorithm that detects a user's own voice).

Figure 3A:
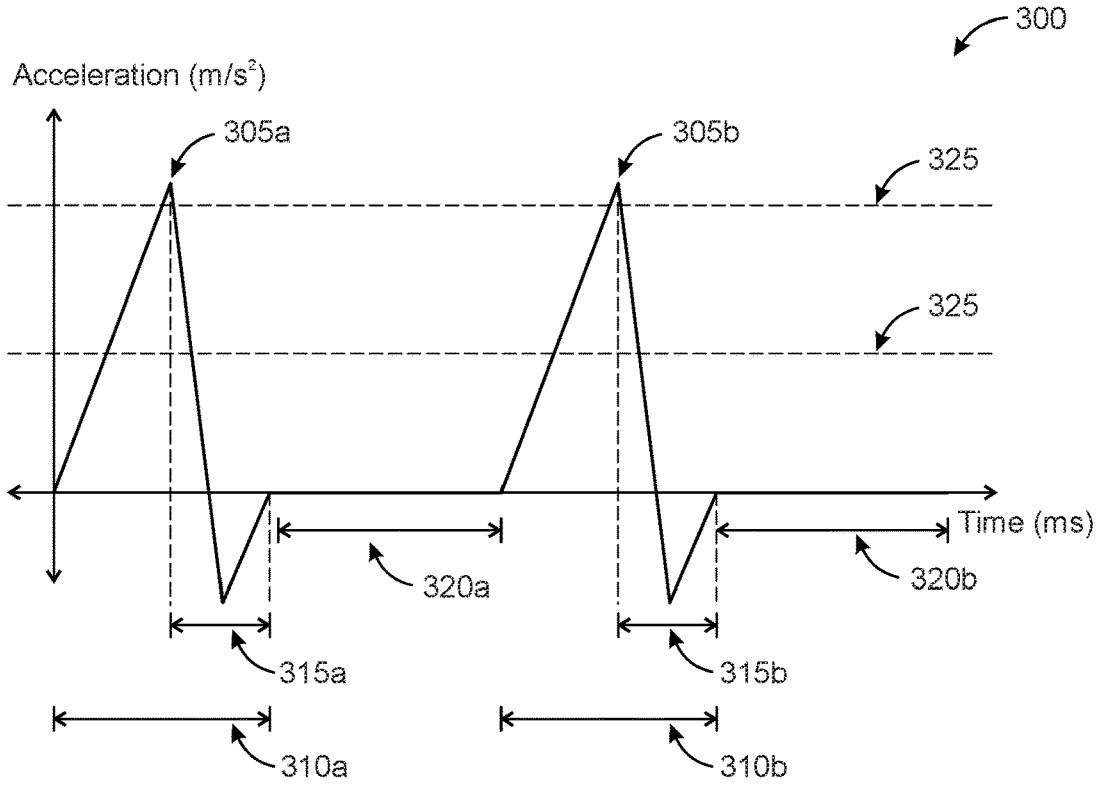
FIGS. 3A and 3B are graphs illustrating detected acceleration in response to tapping a hearing device in accordance with some implementations of the disclosed technology.

FIG. 3A is a graph 300 illustrating detected acceleration in response to tapping a hearing device. On the y-axis is measured acceleration (in units of m/s$^2$) and on the x-axis is time (e.g., in milliseconds (ms)). The graph 300 shows two taps, a first tap followed by a second tap. The first tap (left side) has a peak in acceleration at 305*a* and the second tap (middle right) has a peak in acceleration at 305*b*. The first tap has measurable acceleration effects that last for a duration period 310*a* and the second tap has measurable effects that last for duration period 310*b*. After the peak, there is a shock period 315*a* (first tap) and 315*b* (second tap) that relates to the acceleration of the hearing device in response to the tap. Additionally shown, there is a quiet period 320*a* between the first tap and the second tap, which refers to when little to no changes in acceleration are detected. Depending on a person's double tapping pattern, the quiet period 320*a* (or quiet period 320*b* after the second tap) can vary.

Figure 3B:
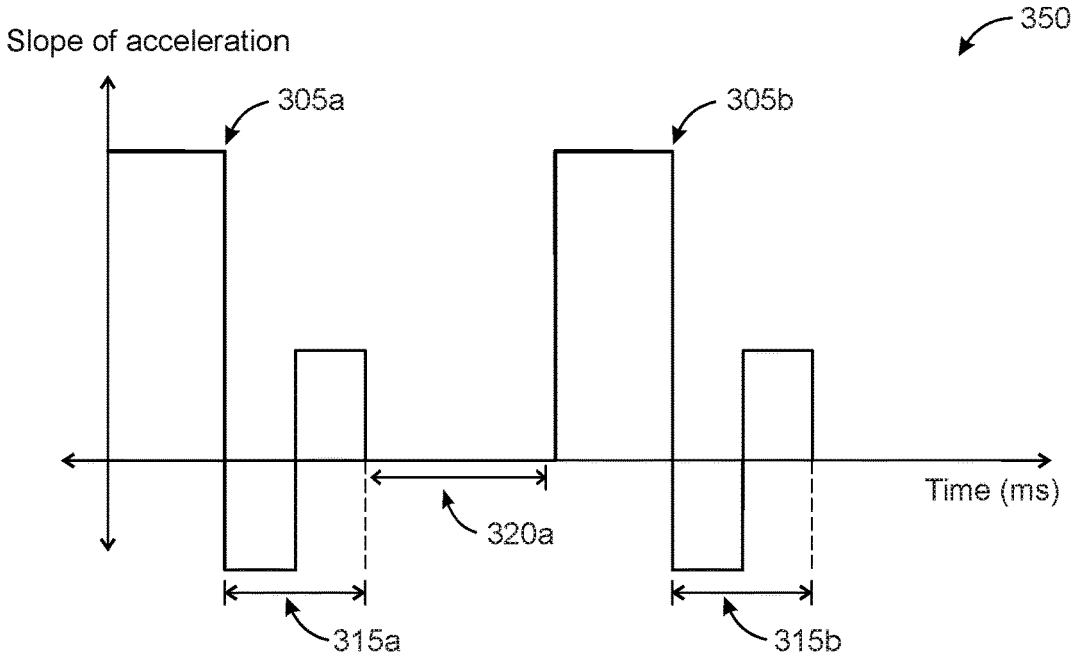

FIG. 3B is a graph 350 illustrating the slope (first derivative) of the measured acceleration of the hearing device versus time (ms). The graph is for illustrative purposes and likely varies slightly based on actual conditions of the hearing device, e.g., type of accelerometer, position of accelerometer, or composition and weight of the hearing device. As shown in FIG. 3B, the graph has a positive slope until peak 305*a* and then it has a negative slope, which indicates acceleration in the opposite direction. During the quiet period 320*a*, there is no change in acceleration detected. Although slope is illustrated in FIG. 3B, in some implementations, the disclosed technology can calculate a "slope magnitude", which is generally the absolute value of the slope (mathematically it is sqrt(slope_x^2+slope_y^2+slope_z^2)).

The slope of acceleration can be used to adjust the sensitivity associated with detecting a tap. For example, the hearing device may only register a tap if the slope of acceleration is above a slope threshold (e.g., magnitude of 5). The hearing device can also adjust this slope threshold based on context. For example, if the hearing device wants to be more sensitive to detecting a tap, it can set the slope threshold to be low (e.g., 3 or less); and if the hearing device wants less sensitivity it can set the slope threshold high (e.g., 3 or more). The high slope threshold can be used for detecting a tap when the user is walking or running, e.g., because the walking and running already creates some acceleration that could be interpreted as an (unwanted) tap. A high threshold can prevent false positives depending on the context.

Figure 4:
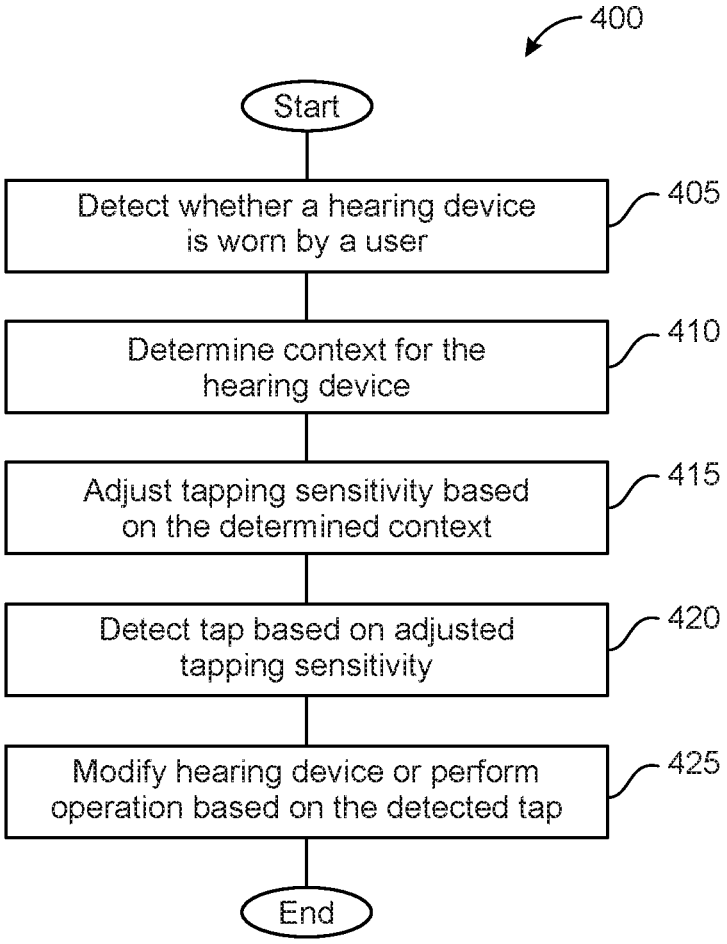
FIG. 4 is a block flow diagram illustrating a process to adjusts tap detection for a hearing device based on context in accordance with some implementations of the disclosed technology.

FIG. 4 illustrates a block flow diagram for a process 400 for detecting a tap for a hearing device. The hearing device 103 may perform part or all of the process 400. The process 400 can begin with detecting user wearing operation 405 and continue to determine context operation 410. The process 400 is considered an algorithm for adjusting tap control based on context.

At detect user wearing operation 405, the hearing device determines whether the user is wearing the hearing device. The hearing device can determine whether a user is wearing the hearing device based on receiving information from an accelerometer. For example, if the accelerometer detects that the gravitational force it is sensing relates to gravitational force experienced by placing the hearing device on or around an ear, the hearing device can detect the device is worn. Alternatively, the hearing device can detect that it is worn based on other parameters. For example, the hearing device can determine that it is worn based on a 2 minute period expiring after the hearing device is turned on or based on hearing the user speak for more than 5 seconds. Although the process 400 includes detect user wearing operation 405, the detect user wearing operation 405 is an optional step (e.g., the process 400 can exclude the detect user wearing operation 405 and begin with another operation). In some implementations, the hearing device turns off tap control or does not adjust detect taps until the hearing device has been turned on for 15 seconds (e.g., boot up process) or is the hearing device user is wearing the hearing device.

At determine context operation 410, the hearing device determines the context for the hearing device. The hearing device can determine the context for a hearing device in several ways. In some implementations, the hearing device determines based on the context of the classification of the hearing device (e.g., using a DSP). The classification can be speech, speech in noise, quiet, or listening to music. In each of these classified settings, the hearing device can have different tap sensitivities. For example, as shown in Table 2, the hearing device can have a low tap sensitivity for single taps that cause the volume to go down.

At adjust tapping sensitivity operation 415, the hearing device adjust the tapping sensitivity based on the context. Based on the context determined in the determine context operation 410, the hearing device can determine associated tapping sensitivities and thresholds for a context and set the thresholds according to the context. For example, if the context requires low sensitivity, the hearing device can increase the threshold (e.g., the first threshold or the second threshold) to a higher threshold. Alternatively, if the context requires high sensitivity, the hearing device can adjust the threshold to a lower threshold. High sensitivity is generally for scenarios where a hearing device user is more likely to tap or double tap (e.g., answering a phone call or changing the volume in a noise condition).

At detect tapping operation 420, the hearing device detects a tapping based on the adjusted tapping sensitivity set in the adjust tapping sensitivity operation 415. In some implementations, the hearing device may receive two or more taps, and the hearing device can expect these taps and adjust parameters to according to the context to detect these multiple taps.

At modify hearing device or perform operation 425, the hearing device modifies the hearing device or performs and operation. The hearing device can modify the hearing device to change a parameter based on the detected tap or taps. The hearing device can change the hearing profile, the volume, the mode of the hearing device, or another parameter of the hearing device. For example, the hearing device can increase or decrease the volume of a hearing device based on the detected tap. Additionally, the hearing device can perform an operation in response to a tap. For example, if the hearing device receive a request to answer a phone and it detected a single tap (indicating the phone call should be answered), the hearing device can transmit a message to a mobile phone communicating with the hearing device to answer the phone call. Alternatively, the hearing device can transmit a message to the mobile phone to reject the phone call based on receiving a double tap.

The hearing device can perform other operations based on receiving a single or double tap. The hearing device can accept a wireless connection, confirm a request from another wireless device, cause the hearing device to transmit a message (e.g., a triple tap can indicate to other devices that the hearing device is unavailable for connecting).

After modify hearing device or perform operation 425, the process 400 can be repeated entirely, repeated partially (e.g., repeat only operation 410), or stop.

Aspects and implementations of the process 400 of the disclosure have been disclosed in the general context of various steps and operations. A variety of these steps and operations may be performed by hardware components or may be embodied in computer-executable instructions, which may be used to cause a general-purpose or special-purpose processor (e.g., in a computer, server, or other computing device) programmed with the instructions to perform the steps or operations. For example, the steps or operations may be performed by a combination of hardware, software, and/or firmware such with a wireless communication device or a hearing device.

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, read-only memory (ROM), random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

We claim:

1. A hearing device, the hearing device comprising:

a microphone configured to receive sound and convert the sound into audio signals;

an accelerometer configured to detect a change in acceleration of the hearing device;

a processor configured to receive the audio signals from the microphone and receive information from the accelerometer;

a memory, electronically coupled to the processor, storing instructions that cause the hearing device to perform operations, the operations comprising:

determine a context for the hearing device based on the sound received at the hearing device, a wireless communication signal from an external device received at the hearing device, or the information received from the accelerometer;

adjust a tapping sensitivity threshold of the hearing device based on the context, wherein the tapping sensitivity threshold is associated with a magnitude of a slope of acceleration of a tap, wherein the magnitude of the slope of the acceleration of the tap is based on $\sqrt{x^2+y^2+z^2}$, wherein x is associated with slope of acceleration in the x direction, y is slope of associated with acceleration in the y-direction, and z is associated with slope of acceleration in the z-direction;

detect a tap of the hearing device based on the adjusted tapping sensitivity threshold; and modify a parameter of the hearing device or transmit instructions to the external device based on detecting the tap.

2. The hearing device of claim 1, wherein the determining the context for the hearing is based on the sound received at the hearing device and the operation further comprises:

determining a classification for the sound received at the hearing device; and adjusting the tapping sensitivity threshold based on the classification.

3. The hearing device of claim 1, the determining the context for the hearing is based on the wireless communication signal from an external device received at the hearing device, and wherein the wireless communication signal is from a mobile device and the wireless communication signal is related to answering or rejecting a phone call.

4. The hearing device of claim 1, wherein the adjusted tapping sensitivity threshold is a first threshold, and wherein adjusting the adjusted tapping sensitivity threshold of the hearing device based on the context further comprises:

increasing the first threshold and decreasing a second threshold, wherein the second threshold is lower than the first threshold; or increasing the second threshold and decreasing the first threshold, wherein the second threshold remains lower than the first threshold.

5. The hearing device of claim 1, wherein the tap is a first tap, and wherein the operations further comprise:

detecting a second tap after the first tap.

6. The hearing device of claim 5, wherein the operation further comprise:

determining that a quiet period or shock period time has expired before detecting the second tap.

7. The hearing device of claim 6, wherein the operations further comprise:

modifying a setting of the hearing device or transmitting instructions to the external device based on detecting the tap.

8. The hearing device of claim 1, further comprising:

an own voice detection unit configured to detect a voice of the hearing device user and separate such voice signals from other audio signals.

9. The hearing device of claim 7, wherein the microphone is a first microphone further comprises:

a second microphone configured to convert the sound into other audio signals, wherein the second microphone is configured to receive the sound from an interior of an ear canal and positioned within the ear canal, wherein the first microphone is configured to receive sound from an exterior of the ear canal.

10. A method for operating a hearing device, the method comprising:

determining a context for a hearing device based on sound received at the hearing device, a wireless communication signal from an external device received at the hearing device, or the information received from the accelerometer;

adjusting a tapping sensitivity threshold of the hearing device based on the context, wherein the tapping sensitivity threshold is associated with a magnitude of a slope of acceleration of a tap, wherein the magnitude of the slope of the acceleration of the tap is based on $\sqrt{x^2+y^2+z^2}$, wherein x is associated with slope of acceleration in the x direction, y is slope of associated with acceleration in the y-direction, and z is associated with slope of acceleration in the z-direction;

detecting a tap of the hearing device based on the adjusted sensitivity threshold; and modifying a parameter of the hearing device or transmitting instructions to the external device based on detecting the tap.

11. The method of claim 10, wherein the tap is a first tap, and wherein the operations further comprise:

detecting a second tap after the first tap based on the context.

12. The method of claim 11, the method further comprising:

adjusting a tapping period based on determining that a quiet period or shock period time has expired before detecting the second tap.

13. The method of claim 10, wherein the determining the context for the hearing is based on sound received at the hearing device and the operation further comprises:

determining a classification for the sound received at the hearing device; and adjusting the tapping sensitivity threshold based on the classification.

* * * * *